US009329536B1

(12) United States Patent
Hatakeyama et al.

(10) Patent No.: US 9,329,536 B1
(45) Date of Patent: May 3, 2016

(54) IMAGE FORMING APPARATUS WITH BUILT-IN CLEANING MECHANISM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Satoshi Hatakeyama, Kanagawa (JP); Susumu Takahashi, Shizuoka (JP); Yoshihiko Sugiyama, Saitama (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/534,272

(22) Filed: Nov. 6, 2014

(51) Int. Cl.
*G03G 15/20* (2006.01)

(52) U.S. Cl.
CPC ..... *G03G 15/2025* (2013.01)

(58) Field of Classification Search
CPC ..... G03G 15/2075; G03G 15/2064; G03G 15/2025
See application file for complete search history.

(56) References Cited

U.S. PATENT DOCUMENTS

2011/0222924 A1* 9/2011 Aoyama et al. ..... 399/327
2011/0243620 A1* 10/2011 Mitsuhashi et al. ..... 399/327
2014/0153938 A1* 6/2014 Saito ..... 399/33

* cited by examiner

*Primary Examiner* — Clayton E Laballe
*Assistant Examiner* — Ruifeng Pu
(74) *Attorney, Agent, or Firm* — Amin, Turocy & Watson LLP; Gregory Turocy

(57) ABSTRACT

In accordance with one embodiment, an image forming apparatus comprises a fixing device configured to include a heating roller heated by a heating section and a pressing roller for pressing the heating roller; and a cleaning sheet configured to be stretched between a first reel and a second reel and wound on at least one of the first reel and the second reel to clean the heating roller; wherein the cleaning sheet is separated from or contacted with the heating roller by a movable member.

10 Claims, 8 Drawing Sheets

IMAGE FORMING APPARATUS WITH BUILT-IN CLEANING MECHANISM

FIELD

Embodiments described herein relate generally to an image forming apparatus which passes an image receiving medium to which toner is adhered through a fixing device and applies heat and pressure to the toner to fix the toner on the image receiving medium.

BACKGROUND

Conventionally, in an electrophotographic type image forming apparatus, paper to which toner is adhered is conveyed to a fixing device. The fixing device heats and presses the conveyed paper to fix the toner on the paper. The fixing device is provided with a heating roller and a pressing roller.

Incidentally, toner, paper fiber and the like may adhere to the surface of the heating roller of the fixing device as a foreign matter. For example, the toner that is not fixed on the paper and is left on the heating roller may adhere to the next conveyed paper as a foreign matter. The foreign matter adhering to the paper is fixed on the paper as a noise image and discharged. Further, the foreign matter adhering to the heating roller may also adhere to the pressing roller in the fixing process. The foreign matter adhering to the pressing roller is fixed on the back side of the next conveyed paper as a noise image.

There is an example in which the foreign matter is cleaned to prevent the occurrence of the noise image. For example, the heating roller is subjected to blade cleaning, roller cleaning, cleaning based on a fiber sheet, and the like.

However, the blade cleaning and the roller cleaning may cause damage in the surface of the heating roller easily. Further, in an example of pressing a fiber sheet against the heating roller to clean the heating roller, there are problems that the fiber sheet breaks or that the fiber sheet is slack. Thus, the service life of the fiber sheet is short and it is necessary to exchange the fiber sheet frequently. Further, there is a problem in the cleanability. Particularly, to maintain the long life of the fixing device, it is not preferred to exchange the cleaning member frequently.

DETAILED DESCRIPTION

Figure 1:
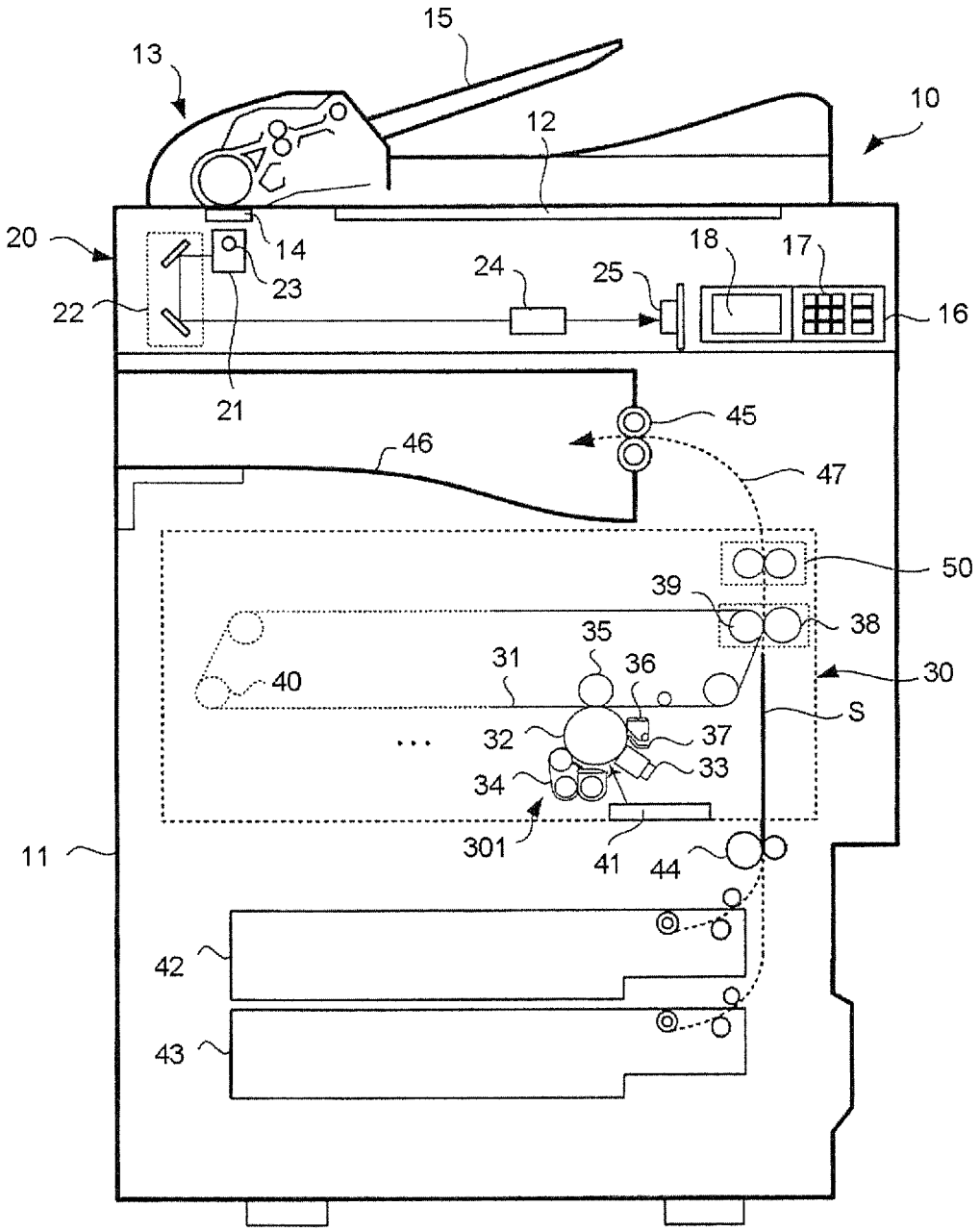
FIG. 1 is a constitution diagram illustrating an image forming apparatus according to one embodiment.

In accordance with one embodiment, an image forming apparatus comprises a fixing device configured to include a heating section, a heating roller heated by the heating section and a pressing roller for pressing the heating roller; a cleaning sheet configured to be stretched between a first reel and a second reel and wound on at least one of the first reel and the second reel to clean the heating roller; and a movable member configured to separate the cleaning sheet from the heating roller or to contact the cleaning sheet with the heating roller.

Hereinafter, the image forming apparatus according to the embodiment is described in detail with reference to the accompanying drawings. In addition, the same components in each drawing are indicated by the same reference numerals.

A First Embodiment

FIG. 1 is a constitution diagram illustrating the image forming apparatus according to the embodiment. An image forming apparatus 10 may be, for example, an MFP (Multi-Function Peripherals), a printer, a copier and the like. In the following description, an MFP is exemplified as the image forming apparatus 10.

A document table 12 is arranged at the upper portion of a main body 11 of the MFP 10. An automatic document feeder (ADF) 13 that can be opened and closed freely is arranged on the document table 12. A glass 14 constituting a document reading window is fixed at the lower portion of the ADF 13. A tray 15 for placing the document is arranged in the ADF 13. An operation panel 16 is arranged at the upper portion of the main body 11. The operation panel 16 includes various operation keys 17 and a touch panel type display section 18.

A scanner section 20 serving as an image reading device is arranged below the document table 12 of the MFP 10. The scanner section 20 scans the document conveyed by the ADF 13 to read the document. Alternatively, the scanner section 20 scans the document placed on the document table 12 to read the document. The scanner section 20 includes a first carriage 21 and a second carriage 22.

The first carriage 21 is provided with a light source 23 for irradiating the document surface at the inside thereof. The light from the light source 23 is radiated to the document. The light source 23 is, for example, an LED. The light source 23 using the LED extends in a scanning direction (depth direction of the paper surface). The light reflected by the document is reflected by mirrors arranged in the first carriage 21 and the second carriage 22 and is further guided to a CCD (Charge Coupled Device) line sensor 25 through a lens 24.

The CCD line sensor 25 is an image sensor. The light reflected from the document is photoelectrically converted by the CCD line sensor 25. Through the photoelectrical conversion, an electric signal is output from the CCD line sensor 25. The electric signal output from the CCD line sensor 25 is analog-processed and converted into a digital signal. The digital signal is subjected to image processing to generate image data.

In a case of reading the document conveyed by the ADF 13, the scanner section 20 fixes the first carriage 21 at the position of the glass 14 (below the ADF 13). The second carriage 22 is also located at a position nearby the first carriage 21. In a case of reading the document placed on the document table 12, the scanner section 20 moves the first carriage 21 and the second carriage 22 in a vertical scanning direction in a manner of being parallel to the document table 12 to read the document placed on the document table 12.

The horizontal scanning direction is orthogonal to the moving direction of the first carriage 21. The horizontal scanning direction is equivalent to the arrangement direction of the CCD line sensor 25. The vertical scanning direction is orthogonal to the horizontal scanning direction.

A printer section 30 is arranged inside the main body 11 of the MFP 10. The printer section 30 includes a photoconductive drum, laser and the like. The printer section 30 processes the image data read by the scanner section 20 and the image data created by a PC (Personal Computer) and the like to form an image on the image receiving medium. In the following description, paper S is described as the image receiving medium.

The printer section 30 includes an image forming section 301 below a looped transfer belt 31 serving as an image carrier. The image forming section 301 scans and exposes the surface of a photoconductive drum 32 with laser beams from a laser unit 41. An electrostatic latent image is formed on the photoconductive drum 32 through the exposure processing. The laser 41 emits laser light based on the image data read by the scanner section 20. An electrostatic charger 33, a developing device 34, a primary transfer roller 35, a cleaner 36, a blade 37 and the like are arranged around the photoconductive drum 32.

The electrostatic charger 33 fully charges the surface of the photoconductive drum 32 uniformly. The developing device 34 includes a mixer for stirring developing agent and a developing roller to which a developing bias is applied. The developing roller supplies the toner serving as two-component developing agent including toner and carrier for the photoconductive drum 32.

The toner image (image) on the photoconductive drum 32 is transferred to the transfer belt 31 by the primary transfer roller 35. The cleaner 36 removes the toner left on the surface of the photoconductive drum 32 with the blade 37. The toner image transferred to the transfer belt 31 is transferred to the paper S by the secondary transfer roller 38.

The transfer belt 31 stretched by a driving roller 39 and a driven roller 40 is cyclically moved through the rotation of the driving roller 39. The driving roller 39 is arranged opposite to the secondary transfer roller 38. The paper S is conveyed to pass through the space between the driving roller 39 and the secondary transfer roller 38. When the paper S passes through the space between the driving roller 39 and the secondary transfer roller 38, secondary transfer voltage is applied to the paper S through the secondary transfer roller 38. In this way, the toner image on the transfer belt 31 is secondarily transferred to the paper S through the secondary transfer roller 38. The secondary transfer roller 38 constitutes a transfer device for transferring the image to the conveyed paper S.

The image transferred to the paper S is fixed on the paper S by a fixing device 50. The fixing device 50 includes a heating roller and a pressing roller. The paper S is passed through a nip formed between the heating roller and the pressing roller to heat and press the paper S, in this way, the image is fixed on the paper S.

In a case of forming a color image, the printer section 30 includes a plurality of image forming sections 301, that is, yellow (Y), magenta (M), cyan (C) and black (K) image forming sections 301. The plurality of image forming sections 301 are arranged below the transfer belt 31 in a direction from the upstream side to the downstream side. The plurality of image forming sections 301 are structurally identical to each other, therefore, only one image forming section 301 is shown in FIG. 1. In addition, the constitution of the printer section 30 is not limited to the example described above, and the printer section 30 may be of any type.

A plurality of cassettes 42 and 43 is arranged at the lower portion of the main body 11 to store paper of various sizes. The number of the cassettes is not limited to two. A conveyance roller 44 is arranged on a conveyance path from the cassettes 42 and 43 to the secondary transfer roller 38. The conveyance roller 44 conveys the paper S picked up from each of the cassettes 42 and 43 to the printer section 30. The paper S on which the toner image is fixed by the fixing device 50 is discharged to a paper discharge section 46 by a discharge roller 45.

Figure 2:
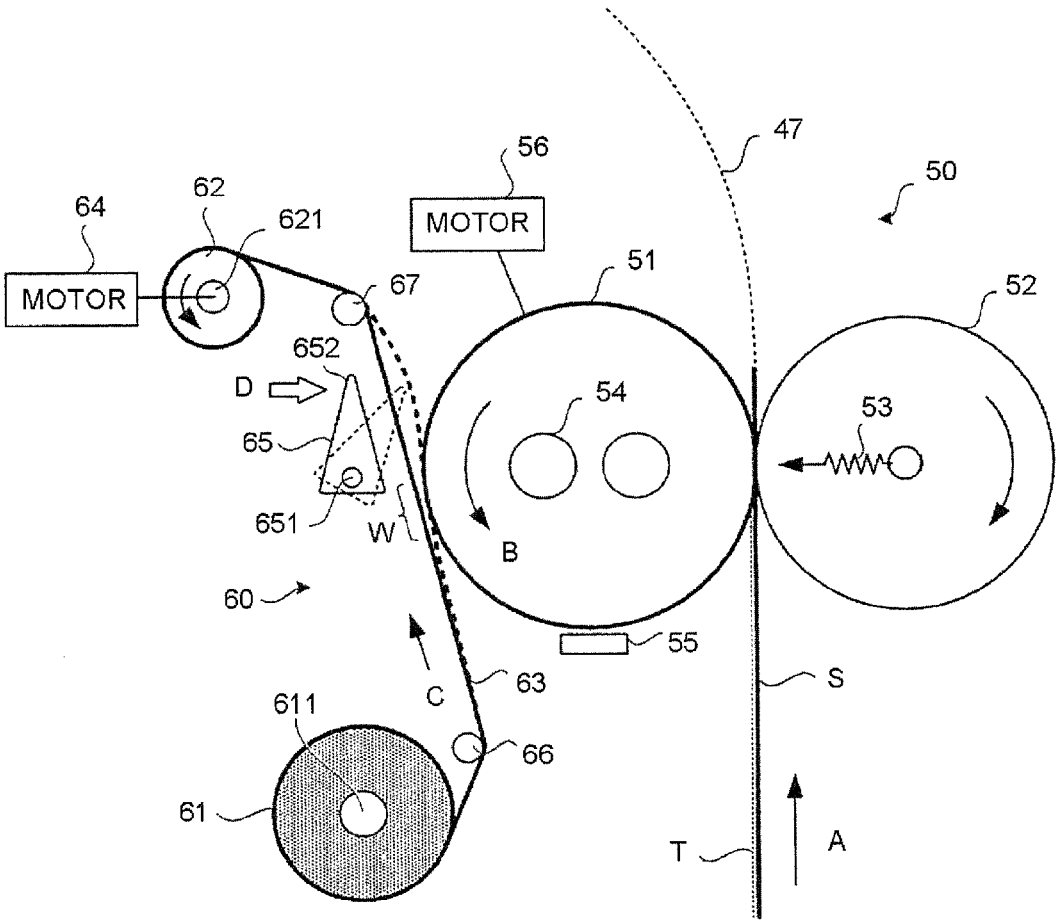
FIG. 2 is a constitution diagram illustrating a fixing device and a cleaner according to the embodiment.

FIG. 2 is a constitution diagram illustrating the fixing device 50 according to the embodiment. The fixing device 50 includes a heating roller 51 and a pressing roller 52. The pressing roller 52 presses the heating roller 51 through a spring 53. The heating roller 51 includes a halogen lamp 54 inside serving as a heating section. The halogen lamp 54 heats the heating roller 51 from inner side through radiant heat.

A temperature sensor 55 such as a thermistor is arranged to contact with the surface of the heating roller 51. The halogen lamp 54 is controlled to be turned on or turned off according to the output of the temperature sensor 55, in this way, the surface of the heating roller 51 is maintained at a given temperature (a temperature at which the toner image can be fixed on the paper). The heating roller 51 is rotationally driven by a motor 56.

The paper S is conveyed in a direction indicated by an arrow A to pass through the space between the pressing roller 52 and the heating roller 51. At this time, the paper S receives heat and pressure from the heating roller 51 and the pressing roller 52, in this way, the toner image formed on the paper S is fixed. Further, the paper S is conveyed in such a manner that the surface on which the toner image (image) T is formed faces the heating roller 51. Thus, there is a case in which the unfixed toner on the paper S is left on the heating roller 51 without being fixed on the paper S. The residual toner is likely to adhere to the heating roller 51 as a foreign matter. In addition, a dotted line 47 in FIG. 2 indicates a conveyance path of the paper S.

A cleaner 60 is arranged in the fixing device 50. The cleaner 60 includes a first reel 61 and a second reel 62. The first reel 61 serves as a feeding reel 61 and the second reel 62 serves as a winding reel 62. The feeding reel 61 and the winding reel 62 rotate around rotation axes 611 and 621, respectively.

A cleaning sheet 63 is wound around the feeding reel 61. The end of the cleaning sheet 63 wound around the feeding reel 61 is fixed on the center part of the rotation axis 621 of the winding reel 62. Thus, when the winding reel 62 is rotated, the cleaning sheet 63 is wound on the winding reel 62. The rotation axis 621 of the winding reel 62 is rotated by a motor 64. When the motor 64 rotates, the cleaning sheet 63 is wound on the winding reel 62. The feeding reel 61 is driven to rotate through the rotation of the winding reel 62.

The feeding reel 61 and the winding reel 62 are arranged to be parallel to the heating roller 51. Further, the width of the cleaning sheet 63 is almost equal to the width in the axis direction of the heating roller 51. In a case in which the rotation direction of the heating roller 51 is a direction B, the winding direction of the cleaning sheet 63 is a direction C. The rotation direction B and the winding direction C are two opposite directions. When the cleaning sheet 63 stretched between the feeding reel 61 and the winding reel 62 is contacted with the heating roller 51, the cleaning sheet 63 cleans the surface of the heating roller 51.

A lever 65 is arranged to contact the cleaning sheet 63 with the outer peripheral surface of the heating roller 51 or to separate the cleaning sheet 63 from the outer peripheral surface of the heating roller 51. The lever 65 constitutes a movable member. The lever 65 is arranged between the heating roller 51 and the winding reel 62. The lever 65 rotates around an axis 651. The movable end 652 of the lever 65 faces the downstream side of the winding direction C of the cleaning sheet 63.

The cleaning sheet 63 is, for example, a fiber sheet (textile, nonwoven fabric and knitting) impregnated with silicon oil. Taking the strength, heat resistance, durability into consideration, the cleaning sheet 63 is preferred to be aramid fiber. Alternatively, the cleaning sheet 63 may be a mixture obtained by mixing PET (polyethylene terephthalate) resin and the like with the aramid fiber. The amount of the silicon oil impregnated into the cleaning sheet 63 is preferred to be more than 10 $g/m^2$. However, if the amount of the silicon oil is too much, oil trace may occur on the fixed paper.

The blade-shaped lever 65 is preferred to be, for example, a silicon material. The movable end 652 of the lever 65 is in a state indicated by a solid line when the fixing device 50 is in a non-fixing mode. The non-fixing mode refers to a preheating process, a standby mode and the like of the fixing device 50. In the non-fixing mode, the cleaning sheet 63 is in a state of being separated from the heating roller 51, which prevents the cleaning sheet 63 from being contacted with the heating roller 51 unnecessarily.

In addition, relay rollers 66 and 67 are arranged between the feeding reel 61 and the winding reel 62. The cleaning sheet 63 is fed from the feeding reel 61 and then wound on the winding reel 62 via the relay rollers 66 and 67. Thus, the contact position between the cleaning sheet 63 and the heating roller 51 does not change even if the amount of the cleaning sheet 63 wound on the winding reel 62 is increased and the amount of the cleaning sheet 63 wound on the feeding reel 61 is decreased.

In a fixing mode in which the fixing device 50 is operated, the cleaner 60 carries out a cleaning operation when the heating roller 51 is rotated. In the fixing mode, the lever 65 is rotated around the axis 651 to a position indicated by the dotted line. After the lever 65 is rotated, the movable end 652 presses the cleaning sheet 63 towards the heating roller 51. When the heating roller 51 is rotated in a state in which the cleaning sheet 63 is contacted with the heating roller 51, the surface of the heating roller 51 is cleaned by the cleaning sheet 63. In this way, the foreign matter adhered to the heating roller 51 can be removed.

As the cleaning processing is carried out, the cleaning sheet 63 becomes dirty. Thus, every time a given number of paper S are conveyed, the winding reel 62 is rotated to wind a certain amount of cleaning sheet 63 on the winding reel 62. For example, every time ten sheets of A4-sized paper are conveyed to pass through the fixing device 50, about 1 mm of the cleaning sheet 63 is wound on the winding reel 62. Further, the winding amount, winding speed and the winding frequency may be changed according to the printing rate.

When the printing rate is high, the dirt on the surface of the heating roller 51 is increased, and the cleanability of the cleaning sheet 63 is reduced. The dirt on the surface of the heating roller 51 may also cause a poor winding state of the cleaning sheet 63. Thus, the winding amount, winding speed or the winding frequency is changed according to the printing rate. When the printing rate is high, for example, every time five sheets of A4-sized paper are conveyed to pass through the fixing device 50, about 2 mm of the cleaning sheet 63 is wound on the winding reel 62.

Further, the lever 65 may change the pressing force applied to press the cleaning sheet 63 against the heating roller 51. In this way, a contact width (W) indicating the area where the cleaning sheet 63 is contacted with the heating roller 51 can be changed. For example, it is set that the contact width (W) is widened as the printing rate of the paper S is increased.

Figure 3:
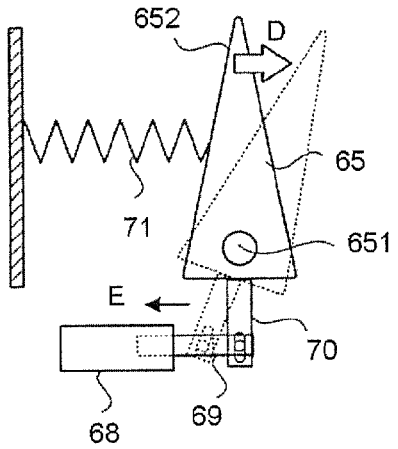
FIG. 3 is a diagram illustrating an example of a rotation mechanism of a movable member according to the embodiment.

FIG. 3 is a diagram illustrating an example of a rotation mechanism of the lever 65. FIG. 3 shows an example in which the lever 65 is rotated through a solenoid 68. A projection 70 is arranged on the lever 65 at a position corresponding to the axis 651. A movable axis 69 of the solenoid 68 is connected with the projection 70. The movable end 652 of the lever 65 is energized in a direction (a direction opposite to the direction D) away from the heating roller 51 by a spring 71.

When the solenoid 68 is turned off, as shown by the solid line, the lever 65 is not rotated. When the solenoid 68 is turned on, the movable axis 69 is drawn in a direction indicated by an arrow E. When the movable axis 69 is drawn, the lever 65 is rotated in a direction indicated by an arrow D around the rotation axis 651. The state in which the lever 65 is rotated is indicated by the dotted line. After the lever 65 is rotated, as shown in FIG. 2, the movable end 652 presses the cleaning sheet 63 against the heating roller 51. Thus, the surface of the heating roller 51 can be cleaned by the cleaning sheet 63.

In addition, when the feeding reel 61 is idled or when the winding reel 62 is rotated reversely, the cleaning sheet 63 becomes slack. Thus, a slack prevention member is arranged in the feeding reel 61. The idling of the feeding reel 61 may be caused when, for example, the feeding reel is rotated by inertia even if the operation of the cleaner 60 is stopped.

Figure 4B:
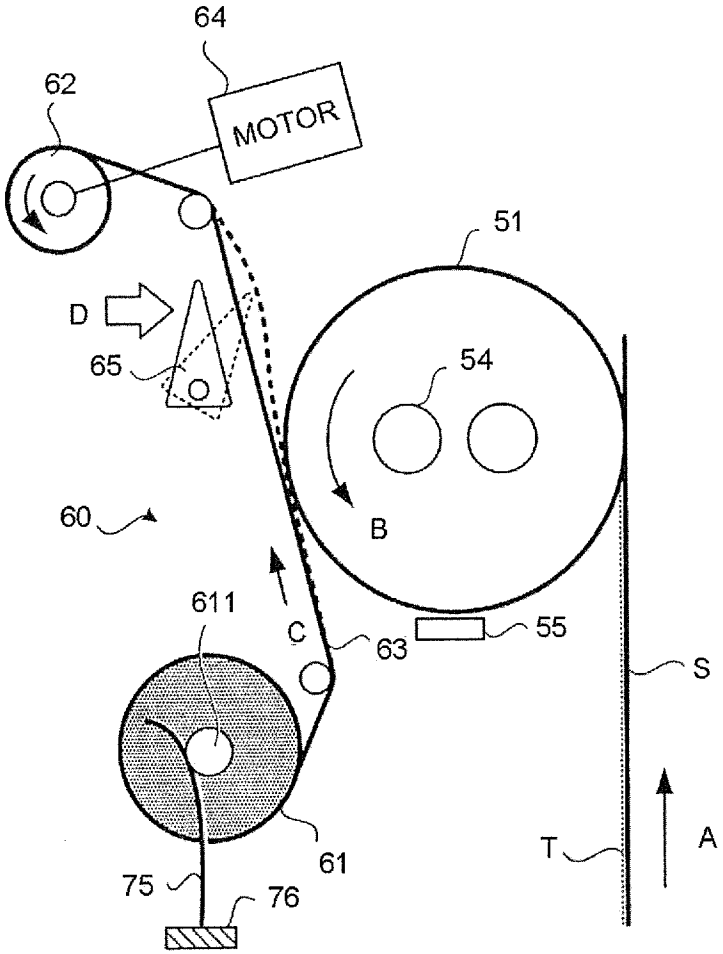
FIG. 4A and FIG. 4B are constitution diagrams illustrating examples of a slack prevention member of a cleaning sheet according to the embodiment.
Figure 4A:
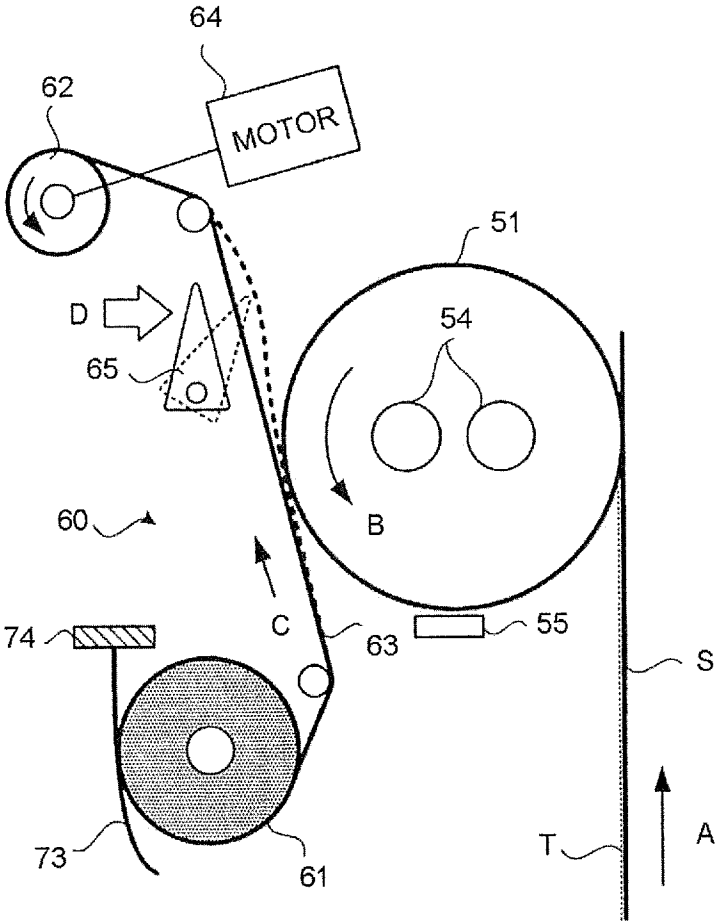

FIG. 4A and FIG. 4B are constitution diagrams illustrating examples of the slack prevention member of the cleaning sheet 63. FIG. 4A shows an example in which a plate spring 73 serving as the slack prevention member is arranged at the outer periphery of the cleaning sheet 63 wound on the feeding reel 61. The plate spring 73 is fixed on a fixed part 74. The plate spring 73 contacts (in pressure) with the outer periphery of the cleaning sheet 63 wound on the feeding reel 61 through the elastic force thereof, which can prevent the idling of the feeding reel 61 and thereby preventing the slack of the cleaning sheet 63.

FIG. 4B shows an example in which a plate spring 75 serving as the slack prevention member is arranged at the outer periphery of the rotation axis 611 of the feeding reel 61. The plate spring 75 is fixed on a fixed part 76. The plate spring 75 contacts (in pressure) with the outer periphery of the rotation axis 611 of the feeding reel 61 through the elastic force thereof, which can prevent the idling of the feeding reel 61 and thereby preventing the slack of the cleaning sheet 63.

Further, a one-way clutch may be inserted into the rotation axis 621 of the winding reel 62 to prevent the slack of the cleaning sheet 63. The slack of the cleaning sheet 63 can be prevented by preventing the reverse rotation of the rotation axis 621 of the winding reel 62.

Figure 5:
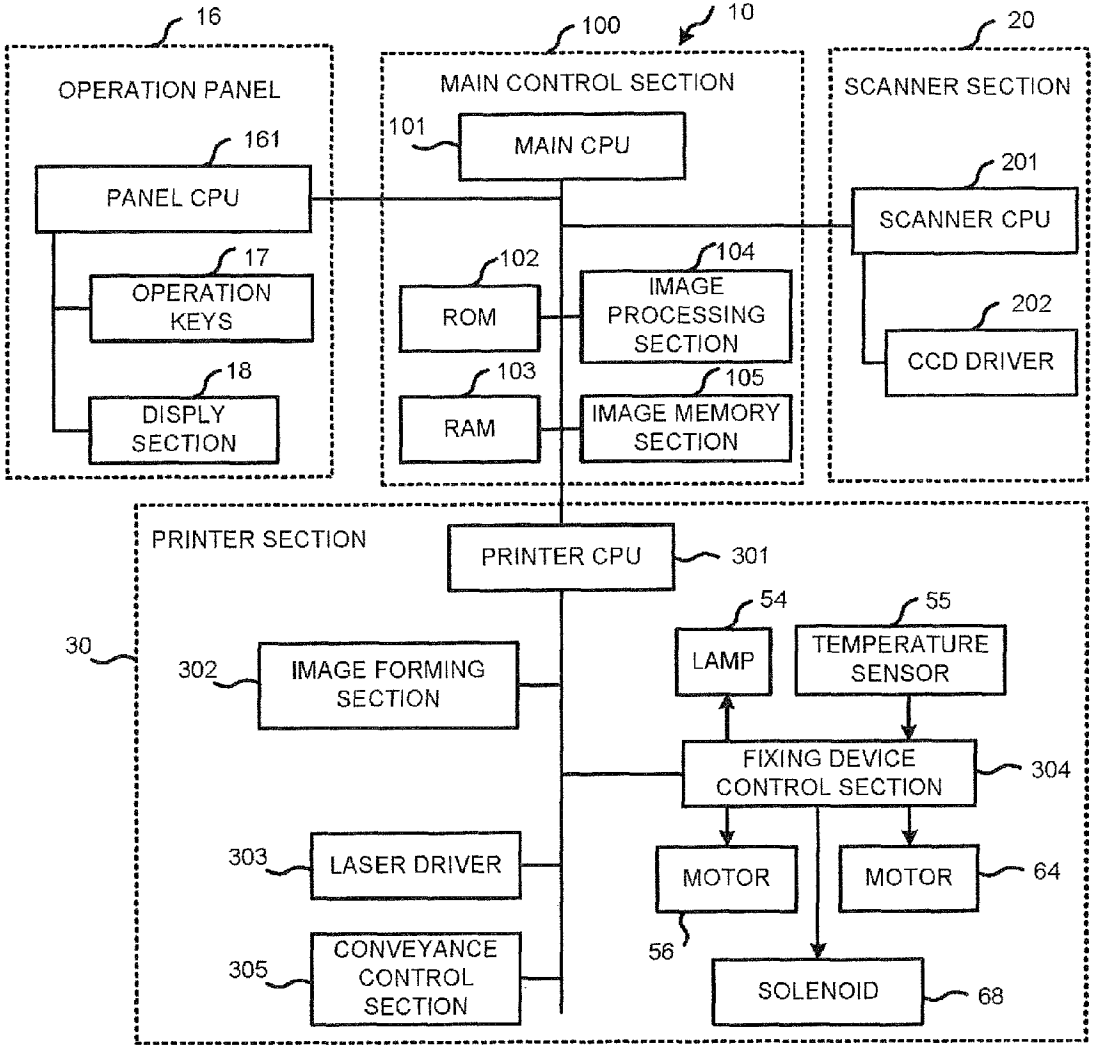
FIG. 5 is a block diagram illustrating a control system of the image forming apparatus according to the embodiment.

FIG. 5 is a block diagram illustrating the constitution of a control system of the image forming apparatus 10 according to the embodiment. In FIG. 5, the image forming apparatus 10 includes a main control section 100, the operation panel 16, the scanner section 20 and the printer section 30. The control system of the image forming apparatus 10 carries out communication between each CPU including a plurality of CPUs such as a main CPU 101 of the main control section 100, a panel CPU 161 of the operation panel 16, a scanner CPU 201 of the scanner section 20 and a printer CPU 301 of the printer section 30.

The main control section 100 includes the main CPU 101, an ROM 102, an RAM 103, an image processing section 104, an image memory section 105 such as an HDD, and the like. The main CPU 101 controls the whole operations of the image forming apparatus 10. The ROM 102 stores control programs and the like. The RAM 103 temporarily stores data when the main CPU 101 carries out various kinds of processing.

The image processing section 104 processes the image data read by the scanner section 20 and the image data sent from a PC and the like. The image data processing includes, for example, image conversion processing for enlarging/reducing an image.

Further, the image memory section 105 stores the image data read by the scanner section 20 and the image data (file data, drawn image data and the like) sent from a PC and the like in a compressed manner. The image data stored in the image memory section 105 is input to the image processing section 104. Various kinds of image processing are carried out by the image processing section 104. The image data from the image processing section 104 is printed on the paper by the printer section 30.

The operation panel 16 includes the panel CPU 161 connected with the main CPU 101, various operation keys 17 and a display section 18 including a liquid crystal screen and the like. The operation keys 17 include numeric keys for instructing the number of printings and the like. The display section 18, having a touch panel function, inputs instructions on the paper size, printing magnification, simplex printing, duplex printing and the like.

The scanner section 20 includes a CCD driver 202 for driving the image sensor. The CCD driver 202 drives the image sensor to read the image of the document and convert the image into the image data.

The printer section 30 includes the printer CPU 301, an image forming section 302, a laser driver 303 for driving the laser of a laser unit 41, a fixing device control section 304 for controlling the fixing device 50, a conveyance control section 305 for controlling the conveyance of the paper S, and the like. The printer section 30 carries out printing on the paper through cooperation with the main control section 100.

The printer CPU 301 controls the image forming section 302. The image forming section 302 controls the photoconductive drum 32, the electrostatic charger 33, the developing device 34, the primary transfer roller 35 and the like to form an image.

The fixing device control section 304 controls the rotation of the motor 56 for driving the heating roller 51. The fixing device control section 304, which is connected with the temperature sensor 55, controls the temperature of the halogen lamp 54 of the heating roller 51 according to the temperature detection result of the temperature sensor 55.

Further, the fixing device control section 304 controls the motor 64 for rotating the winding reel 62 of the cleaner 60. The fixing device control section 304 carries out a control to turn on or turn off the solenoid 68. The conveyance control section 305 controls the rotation of motors (not shown) for driving the secondary transfer roller 38, the conveyance roller 44, the discharge roller 45 and the like to control the conveyance of the paper S.

Figure 6:
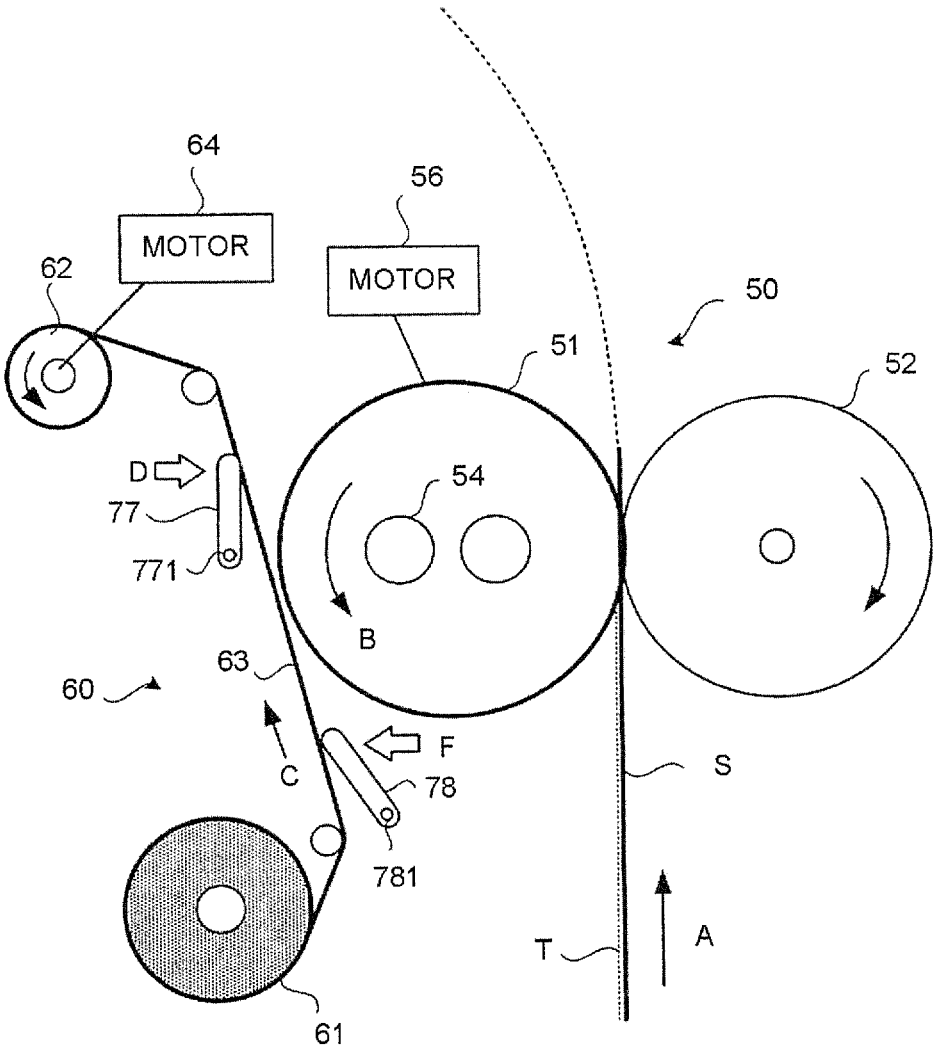
FIG. 6 is a constitution diagram illustrating a modification of the cleaner of the fixing device according to the embodiment.

FIG. 6 is a constitution diagram illustrating a modification of the cleaner 60 of the fixing device 50 according to the first embodiment.

In FIG. 6, a lever 77 and a lever 78 are arranged to press the cleaning sheet 63. The lever 77 and the lever 78 are arranged at two sides of a contact position where the cleaning sheet 63 is contacted with the heating roller 51 by taking the contact position as a center. However, the lever 77 is arranged at one side of the cleaning sheet 63 while the lever 78 is arranged at the other side of the cleaning sheet 63.

The levers 77 and 78, which are formed into a flat plate shape with the front ends rounded, rotate around rotation axes 771 and 781, respectively. Further, the movable ends of the levers 77 and 78 face the winding direction C of the cleaning sheet 63.

When the lever 77 is rotated, the movable end of the lever 77 presses the cleaning sheet 63 in a direction indicated by an arrow D from one side. When the lever 78 is rotated, the movable end of the lever 78 presses the cleaning sheet 63 in a direction indicated by an arrow F from the other side. When the lever 77 is rotated in the direction D and the lever 78 is rotated in a direction opposite to the direction F, the cleaning sheet 63 is pressed to contact with the heating roller 51. Thus, the heating roller 51 is cleaned by the cleaning sheet 63. On the contrary, when the lever 77 is rotated in a direction opposite to the direction D and the lever 78 is rotated in the direction F, the cleaning sheet 63 is separated from the heating roller 51.

In addition, the lever 77 and the lever 78 can be driven to rotate through the rotation mechanism (refer to FIG. 3) in which the solenoid 68 is used. Though it is exemplified that the lever 77 and the lever 78 are formed into a flat plate shape with the front ends rounded, the present invention is not limited to this. Levers in the same shape with the lever 65 shown in FIG. 2 may be used as the lever 77 and the lever 78.

A Second Embodiment

Figure 7:
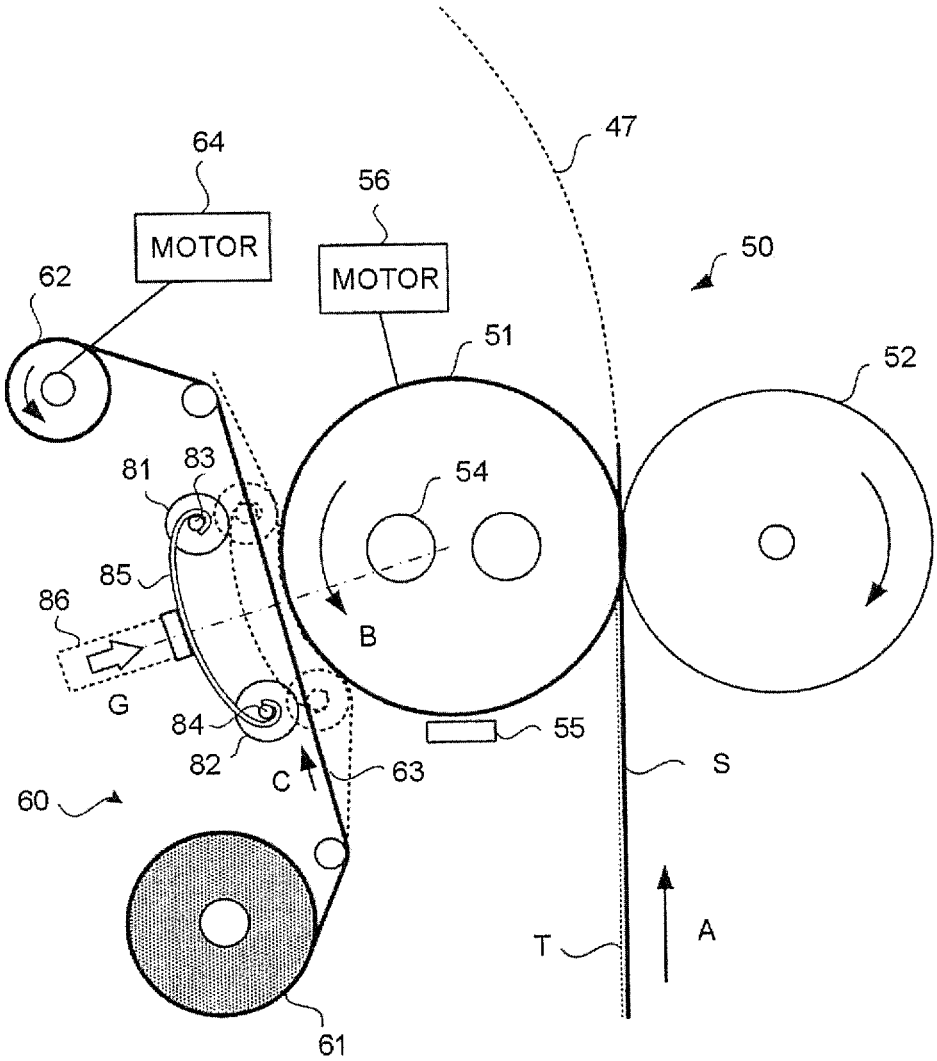
FIG. 7 is a constitution diagram illustrating a fixing device and a cleaner according to a second embodiment.

FIG. 7 is a constitution diagram illustrating a fixing device 50 and a cleaner 60 according to the second embodiment. The constitution of the fixing device 50 in FIG. 7 is the same as that shown in FIG. 2.

The fixing device 50 includes the heating roller 51 and the pressing roller 52, and the heating roller 51 is provided with the halogen lamp 54 inside serving as a heating section. The heating roller 51 is driven to rotate by the motor 56. The paper S is conveyed in a direction indicated by an arrow A to pass through the space between the heating roller 51 and the pressing roller 52. The paper S is conveyed in such a manner that the surface on which the toner image T is formed faces the heating roller 51.

The cleaner 60 includes the feeding reel 61 and the winding reel 62. The cleaning sheet 63 is wound on the feeding reel 61. When the winding reel 62 is rotated, the cleaning sheet 63 is wound on the winding reel 62. The rotation axis of the winding reel 62 is rotated by the motor 64.

In a case in which the rotation direction of the heating roller 51 is the direction B, the winding direction of the cleaning sheet 63 is the direction C. The rotation direction B and the winding direction C are two opposite directions. Further, two pressing rollers 81 and 82 are arranged to contact the cleaning sheet 63 with the outer peripheral surface of the heating roller 51 or to separate the cleaning sheet 63 from the outer peripheral surface of the heating roller 51. The pressing rollers 81 and 82 rotate around axes 83 and 84, respectively.

A plate spring 85 is arranged on two ends of the axes 83 and 84. The pressing rollers 81 and 82 are positioned at two sides of a nip point of the cleaning sheet 63 and the heating roller 51 by taking the nip point as a center. The plate spring 85 can be moved towards the direction (a direction indicated by an arrow G) of the heating roller 51 by a pressing mechanism 86. In the non-fixing mode, the load applied from the pressing mechanism 86 to the plate spring 85 is released, and therefore, the pressing rollers 81 and 82 are located at positions away from the heating roller 51.

When a printing operation such as a copying operation on the paper S is started, the fixing device 50 is turned into the fixing mode. In the fixing mode, the plate spring 85 is pressed towards the direction (a direction indicated by an arrow G) of the heating roller 51 by the pressing mechanism 86, and the pressing rollers 81 and 82 move towards the heating roller 51. The pressing rollers 81 and 82 receiving the force of the plate spring 85 press the cleaning sheet 63 against the surface of the heating roller 51.

When the heating roller 51 is rotated in a state in which the cleaning sheet 63 is contacted with the heating roller 51, the surface of the heating roller 51 is cleaned by the cleaning sheet 63. Thus, the foreign matter adhered to the heating roller 51 can be removed.

Further, every time a given number of paper are conveyed, the winding reel 62 is rotated to wind a certain amount of cleaning sheet 63 on the winding reel 62. For example, every time ten sheets of A4-sized paper are conveyed to pass through the fixing device 50, about 1 mm of the cleaning sheet 63 is wound on the winding reel 62.

Further, the winding amount, winding speed and the winding frequency may be changed according to the printing rate. For example, when the printing rate is high, every time five sheets of A4-sized paper are conveyed to pass through the fixing device 50, about 2 mm of the cleaning sheet 63 is wound on the winding reel 62. In addition, the winding speed is speeded up.

Further, the pressing mechanism 86 of the plate spring 85 may be controlled to change the pressing force applied to press the cleaning sheet 63 against the heating roller 51. In this way, a contact width (W) indicating the area where the cleaning sheet 63 is contacted with the heating roller 51 can be changed. For example, it is set that the contact width (W) is widened as the printing rate of the paper S is increased.

In the embodiment shown in FIG. 7, the pressing rollers 81 and 82 are used instead of the lever 65 shown in FIG. 2. If the force for pressing the pressing rollers 81 and 82 against the cleaning sheet 63 is adjusted, the cleaning sheet 63 will not be damaged. Further, the silicon oil impregnated into the cleaning sheet 63 will not be scraped. The load of the pressing force is preferred to be about 0.2 kgf (±0.5 kgf).

A Third Embodiment

Figure 8:
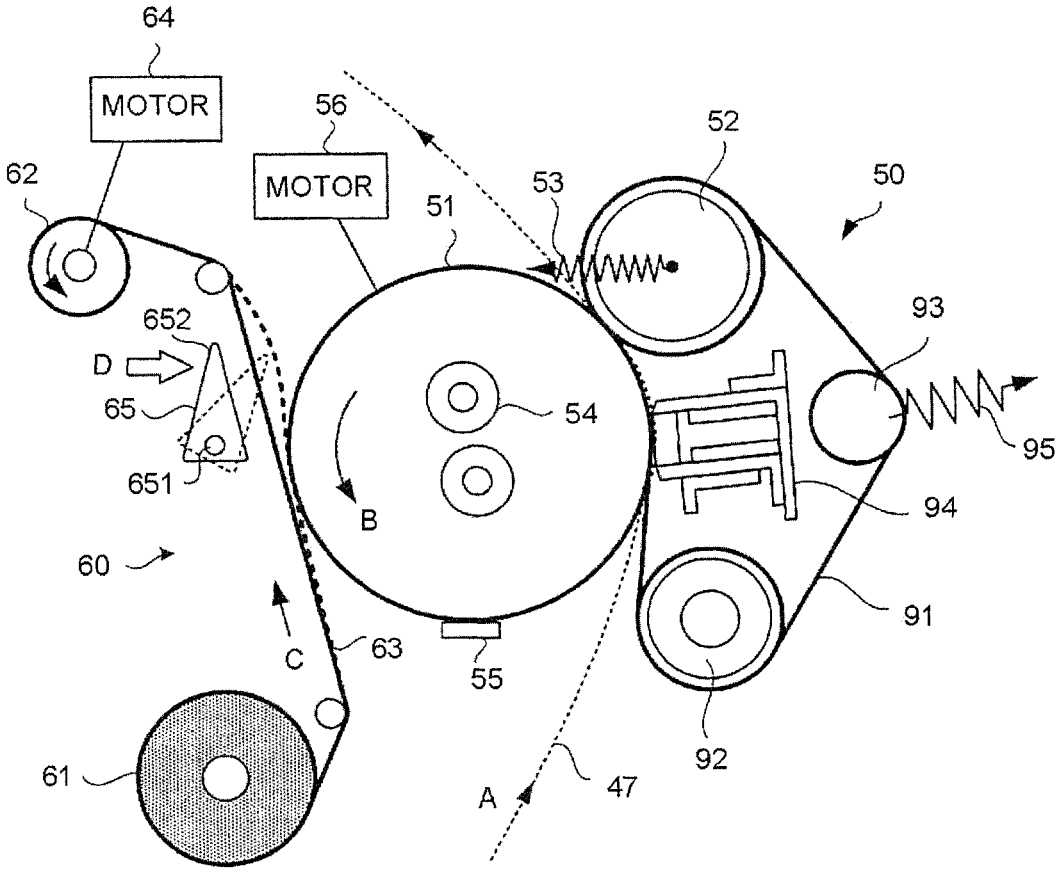
FIG. 8 is a constitution diagram illustrating a fixing device and a cleaner according to a third embodiment.

FIG. 8 is a constitution diagram illustrating a fixing device 50 and a cleaner 60 according to the third embodiment. The constitution of the cleaner 60 in FIG. 8 is the same as that shown in FIG. 2. However, the constitution of the fixing device 50 is different.

The fixing device 50 shown in FIG. 8 includes the heating roller 51, a fixing belt 91, the pressing roller 52, an auxiliary roller 92 and a tension roller 93. The auxiliary roller 92 is arranged at the paper S conveying-in side. The fixing belt 91 is stretched by the pressing roller 52, the auxiliary roller 92 and the tension roller 93. The fixing belt 91 is wrapped around part of the heating roller 51.

Further, the fixing device 50 includes a pad member 94, the halogen lamp 54 for heating, a spring 53 for pressing, and a spring 95 for applying tension. The pressing roller 52 presses the heating roller 51 across the fixing belt 91 through the force of the spring 53. The tension roller 93 applies a given tension to the fixing belt 91 through the spring 95. A fixing nip part is formed from a point where the fixing belt 91 is contacted with the heating roller 51 to a point where the pressing roller 52 presses the heating roller 51.

When the paper S passes through the fixing nip part, heat and pressure are applied to the paper S to fix the toner on the paper S. The heating roller 51 is rotated through the driving force transferred from the motor 56.

The fixing belt 91, the pressing roller 52, the auxiliary roller 92 and the tension roller 93 are driven to rotate through the rotation of the heating roller 51. Further, the fixing belt 91 is pressed against the heating roller 51 by the pad member 94. The heating roller 51 is formed by coating, for example, PTFE (Polytetrafluoroethylene) on the surface of a metal hollow cylindrical cylinder made from iron.

The heating roller 51 includes the halogen lamp 54 inside serving as a heating section. The halogen lamp 54 heats the heating roller 51 from inner side through radiant heat. Further, the temperature sensor 55 such as a thermistor is arranged to contact with the surface of the heating roller 51 to detect the temperature of the heating roller 51. The halogen lamp 54 is controlled to be turned on or turned off according to the output of the thermistor 55. With the halogen lamp 54, the surface of the heating roller 51 is maintained at a given temperature.

The cleaner 60 includes the feeding reel 61 and the winding reel 62. The cleaning sheet 63 is wound on the feeding reel 61. When the winding reel 62 is rotated, the cleaning sheet 63 is wound on the winding reel 62. Further, the lever 65 is arranged to contact the cleaning sheet 63 with the outer peripheral surface of the heating roller 51 or to separate the cleaning sheet 63 from the outer peripheral surface of the heating roller 51.

The lever 65 is formed into a blade shape. The movable end 652 of the lever 65 is in a state indicated by the solid line when the fixing device 50 is in the non-fixing mode. That is, the cleaning sheet 63 is in a state of being separated from the heating roller 51. In the fixing mode, in a case of cleaning the heating roller 51, the lever 65 is rotated around the axis 651 to a position indicated by the dotted line. After the lever 65 is rotated, the movable end 652 presses the cleaning sheet 63 towards the heating roller 51.

When the heating roller 51 is rotated in a state in which the cleaning sheet 63 is contacted with the heating roller 51, the surface of the heating roller 51 is cleaned by the cleaning sheet 63. In this way, the foreign matter adhered to the heating roller 51 can be removed.

A Fourth Embodiment

Figure 9:
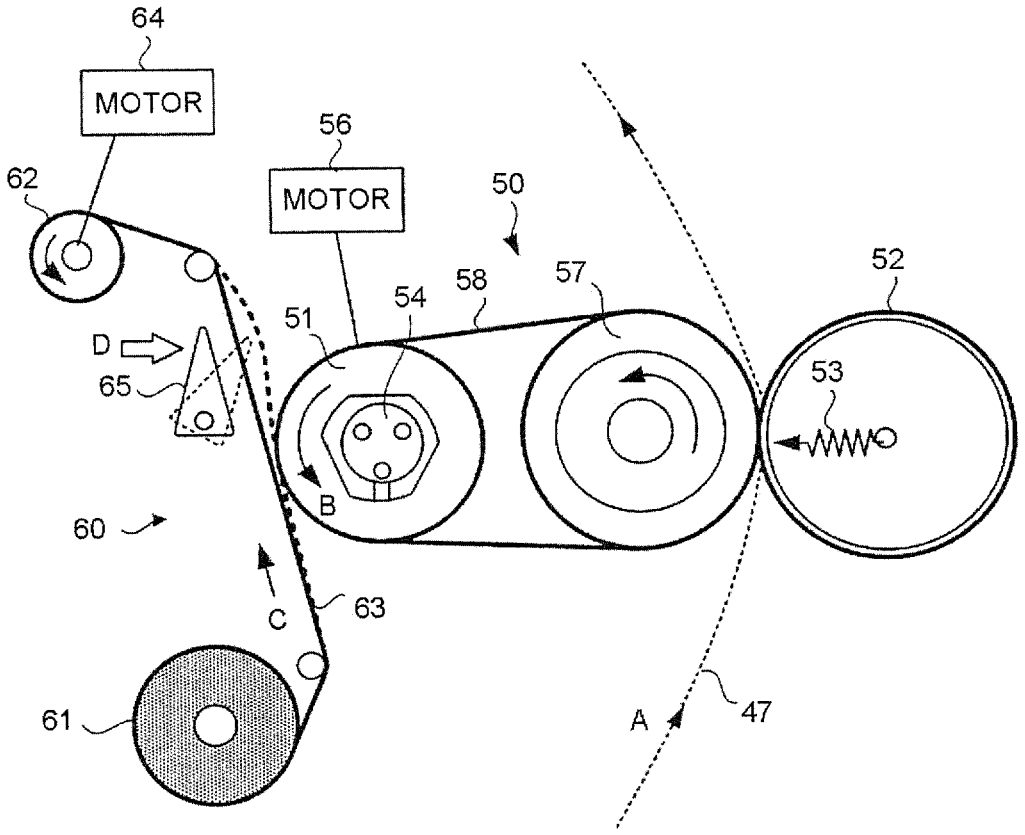
FIG. 9 is a constitution diagram illustrating a fixing device and a cleaner according to a fourth embodiment.

FIG. 9 is a constitution diagram illustrating a fixing device 50 and a cleaner 60 according to the fourth embodiment. The constitution of the cleaner 60 in FIG. 9 is the same as that shown in FIG. 2. However, the constitution of the fixing device 50 is different.

The fixing device 50 includes the heating roller 51, a fixing roller 57, the pressing roller 52, a spring 53 and a fixing belt 58. The heating roller 51 faces the fixing roller 57. The fixing belt 58 is stretched between the fixing roller 57 and the heating roller 51. The fixing belt 58 is heated by a heater 54 arranged inside the heating roller 51.

The pressing roller 52 presses the fixing roller 57 across the fixing belt 58 through the force of the spring 53. The heating roller 51 is rotated anticlockwise and the pressing roller 52 is rotated clockwise, in this way, the paper S is conveyed in a direction indicated by an arrow A in a state of being nipped between the fixing belt 58 and the pressing roller 52. The fixing belt 58 heats the paper S while rotating. Further, the pressing roller 52 presses the paper S against the fixing belt 58 to fix the toner image on the paper S.

That is, in the fourth embodiment, such an example is described in which a belt-like roller is used to heat the paper S. Thus, the heating roller includes a belt-like roller.

The cleaner 60, which is structurally identical to that shown in FIG. 2, includes the feeding reel 61, the winding reel 62 and the cleaning sheet 63. The cleaning sheet 63 is contacted with the outer peripheral surface of the fixing belt 58 to clean the fixing belt 58.

In addition, the cleaner 60 shown in FIG. 8 and FIG. 9 may be structurally identical to that shown in FIG. 6 and FIG. 7. Further, the cleaner 60 shown in FIG. 8 and FIG. 9 may also be provided with the slack prevention member of the cleaning sheet 63 shown in FIG. 4A and FIG. 4B.

As to the cleaner 60 described in first-fourth embodiments, the cleaning sheet 63 can be exchanged when completely being wound on the winding reel 62. Alternatively, the feeding reel 61, the cleaning sheet 63 and the winding reel 62 can be exchanged.

In accordance with the image forming apparatus according to the embodiments described above, in a fixing device in which a heating roller is used, the surface of the heating roller can be cleaned by a cleaning sheet. Thus, the occurrence of noise on the paper can be reduced.

In addition, the present invention is not limited to the embodiments described above, and it may be applied in various forms. For example, a scanning head including an LED element may be used instead of the laser unit 41 including the laser light source.

It is exemplified that the cleaning sheet 63 is wound from the first reel (feeding reel 61) onto the second reel (winding reel 62). However, the present invention is not limited to this. The cleaning sheet 63 may be wound from the second reel onto the first reel.

Furthermore, it is exemplified that the printer section 30 controls the fixing device 50 and the cleaner 60 through the fixing device control section 304, and controls the conveyance of the paper through the conveyance control section 305. However, the present invention is not limited to this. The fixing device 50, the cleaner 60 and the conveyance of the paper may be controlled through a single control section (for example, the main CPU 101).

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a fixing device configured to include a heating section, a heating roller heated by the heating section and a pressing roller for pressing the heating roller;

a cleaning sheet configured to be stretched between a first reel and a second reel and wound on at least one of the first reel and the second reel to clean the heating roller; and a movable member configured to separate the cleaning sheet from the heating roller or to contact the cleaning sheet with the heating roller, wherein the movable member increases the contact width between the cleaning sheet and the heating roller in response to an increased printing rate of an image receiving medium conveyed to the fixing device.

2. The apparatus of claim 1, wherein the movable member operates to separate the cleaning sheet from the heating roller when the fixing device is in a non-fixing mode, and to contact the cleaning sheet with the heating roller when the fixing device is in a fixing mode; and the heating roller is cleaned by the cleaning sheet in the fixing mode.

3. The apparatus of claim 1, further comprising:

a motor configured to rotate the winding reel within the first reel and the second reel to wind a certain amount of cleaning sheet every time a given number of image receiving media are conveyed to pass through the fixing device.

4. The apparatus of claim 3, wherein any of the winding amount, winding speed and the winding frequency of the cleaning sheet based on the winding reel is increased as the printing rate of the image receiving medium becomes higher.

5. The apparatus of claim 1, wherein the movable member is arranged at either or both of the first reel side and the second reel side with respect to a nip point where the cleaning sheet is contacted with the heating roller.

6. The apparatus of claim 5, wherein the movable member is formed as a blade shape of which one end can be rotated around a rotation axis arranged at the other end.

7. The apparatus of claim 5, wherein the movable member includes rollers capable of pressing the cleaning sheet against the heating roller.

8. The apparatus of claim 1, further comprising:

a slack prevention member configured to provide a pressure contact with the outer periphery of a rotation axis of a feeding reel within the first reel and the second reel or with the outer periphery of the cleaning sheet wound on the feeding reel to prevent the slack of the cleaning sheet.

9. The apparatus of claim 1 wherein the cleaning sheet can be exchanged.

10. The apparatus of claim 1, wherein the image receiving medium is paper.

* * * * *